United States Patent [19]

Brandenburg, Jr.

[11] 4,201,121

[45] May 6, 1980

[54] METHOD OF VENTING HEAT FROM HOMES

[76] Inventor: Frank J. Brandenburg, Jr., Rte. 1-Box 487-5, Ashland, Va. 23225

[21] Appl. No.: 929,825

[22] Filed: Jul. 31, 1978

[51] Int. Cl.[2] ..... F24F 7/00; F24F 7/06

[52] U.S. Cl. ..... 98/33 R; 98/42 R; 98/43 R; 98/DIG. 6

[58] Field of Search ..... 98/32, 33 R, 42 R, 42A, 98/43 R, 43 B, 43 C, DIG. 6; 52/199, 200

[56] References Cited

U.S. PATENT DOCUMENTS

| | | | |
|---|---|---|---|
| 1,496,670 | 6/1924 | Floyd | 98/32 |
| 1,874,083 | 8/1932 | Clay | 98/DIG. 6 |
| 2,569,319 | 9/1951 | Krug | 98/43 B |
| 2,665,626 | 1/1954 | Jones | 98/43 R |
| 2,713,301 | 7/1955 | McKann | 98/43 B |
| 3,683,785 | 8/1972 | Grange | 98/DIG. 6 |
| 3,863,553 | 2/1975 | Koontz | 98/42 |
| 4,051,770 | 10/1977 | Felter et al. | 98/43 B |
| 4,085,667 | 4/1978 | Christianson | 98/43 A |
| 4,096,790 | 6/1978 | Curran | 98/42 R |
| 4,103,825 | 8/1978 | Zorning | 98/33 R |

*Primary Examiner*—Henry C. Yuen

*Attorney, Agent, or Firm*—Clarence A. O'Brien; Harvey B. Jacobson

[57] ABSTRACT

A method and apparatus for venting heated air from the upper portions of a room in a dwelling or the like, the invention acts to reduce heat loading within a building by providing a siphon vent pipe which opens into the upper portion of the room and extends upwardly into communication with a draft channel disposed near the roof of the building. Heated air within the upper portions of the room is thereby first vented from the room and then subsequently vented externally of the building through a vent formed in the roof of the building.

7 Claims, 4 Drawing Figures

Fig. 1
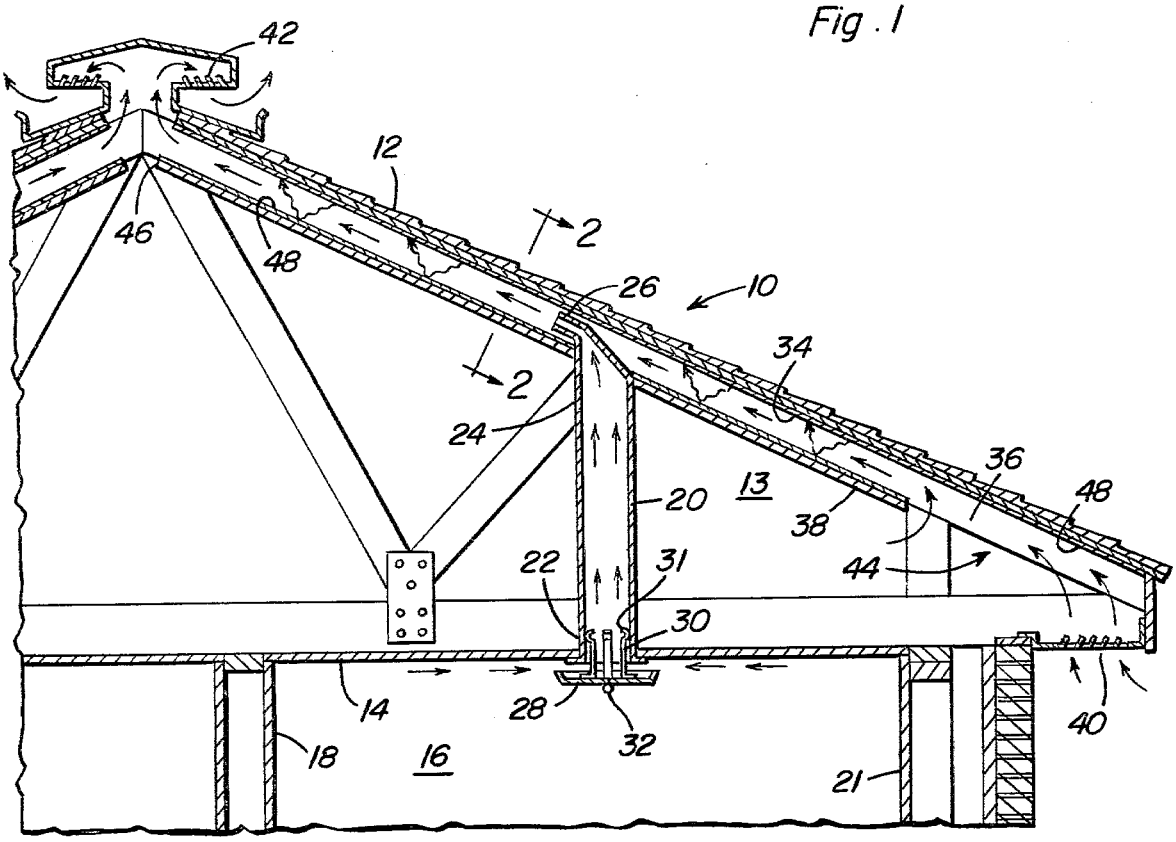
Fig. 2
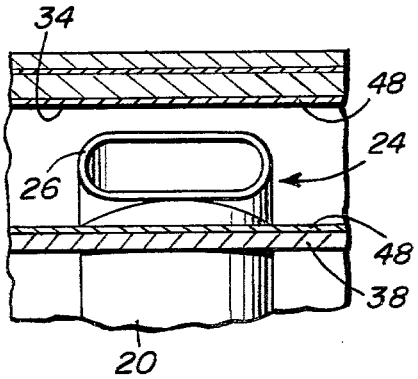
Fig. 3
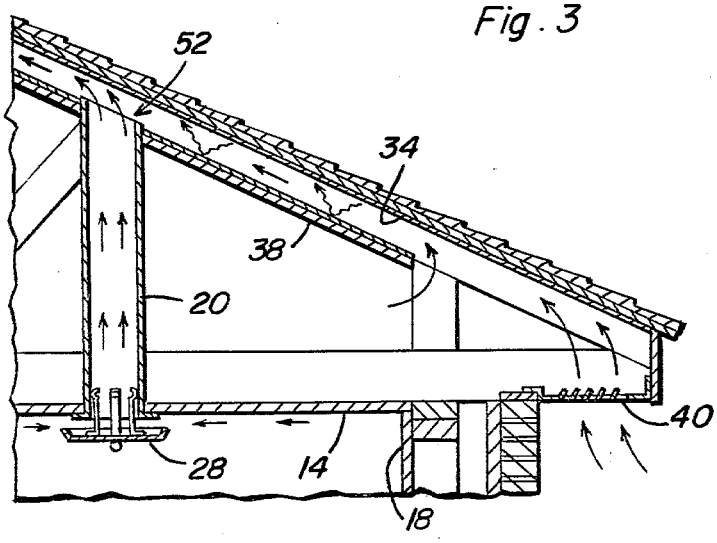
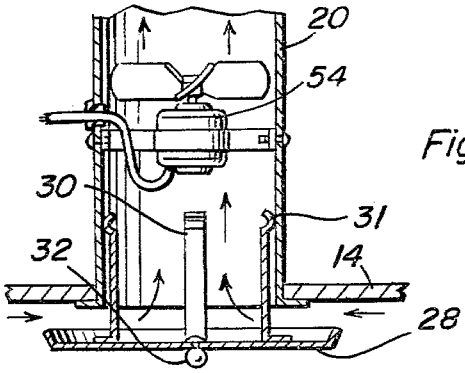
Fig. 4

METHOD OF VENTING HEAT FROM HOMES

BACKGROUND OF THE INVENTION

1. Field of the Invention

The invention generally relates to apparatus for venting heated air from a building to reduce heat loading within the building. In particular, the invention relates to venting of heated air from the upper portions of a room to cool the room.

2. Description of the Prior Art

The prior art has previously recognized problems associated with inadequate ventilation of a building. Such problems are particularly acute during the summer months when excessively hot air accumulates in attics and the like, thereby producing a heat loading within the building which penetrates into living areas to render such areas uncomfortable at best. The use of mechanical refrigeration devices for relieving heat loading in living areas is rendered more costly when attic volumes are not ventilated or are inadequately ventilated. Prior attempts to address these problems have invariably involved venting of heated air from an attic or upper portion of a building (which attic or upper portion typically is not used for habitation). To this end, attic ventilation fans have been commonly provided in the roof of a building, the fan exhausting heated air from the attic on build-up of sufficiently undesirable thermal conditions within the interior of the attic. Natural ventilation systems have also been employed, such systems not requiring power as do attic fans. The natural ventilation systems operate passively by creating natural air flow paths through an attic or upper portion of a building immediately below the roof of the building. However, even with active or passive ventilation systems, substantial heat builds up within an attic of a building to transmit uncomfortable heat loads into environmental spaces of the building. Insulation provided between the attic and a room beneath the attic, while effective in winter, actually serves to aggravate the summer thermal problem since heat from the "radiant heat trap" which an attic becomes in summer penetrates the insulation during the day. This heat must be removed from the insulation by natural or mechanical cooling before the heat loading in the rooms beneath the attic can begin to cool to a comfortable temperature. While insulation assists in conserving heat during the winter, the present invention teaches that insulation (and the more insulation, the worse is the problem) actually causes the time period required to dissipate or mechanically remove a given heat loading from a building to be increased. On an annual basis, insulation may make little difference in total energy cost when mechanical refrigeration is used to cool a building. The present invention therefore is intended to provide a method and apparatus which can be used solely or in combination with existing active and/or passive ventilation systems to reduce the heat loading within a building during "warm" weather and to thereby conserve energy normally required to mechanically cool the building to a comfortable living temperature.

SUMMARY OF THE INVENTION

The present invention provides a method and apparatus for ventilating inter alia that upper portion of an environmental space or room which becomes a heat trap due to solar heat loading primarily on the roof of a building. The heat trap formed in a room in the upper one to two feet thereof is additional to the radiant heat trap which the typical attic becomes during warm weather. Active and passive attic ventilation systems do not remove this heat loading which accumulates in upper portions of rooms. Removal of this heat loading by mechanical refrigeration typically amounts to 40 to 60% of the cost of mechanical cooling. According to the present invention, a passive system is utilized to remove this relatively heated layer of air from the upper portions of a room, the heated layer of air being vented from the room through a siphon duct which opens into the uppermost portion of the room within the heated layer of air and extends upwardly to terminate within and communicate with a draft channel defined by duct work preferably disposed immediately below the roof of the building. The draft channel preferably communicates at a lowermost end with a louvered soffit vent located on the lower surfaces of the eaves of the building. The uppermost end of the draft channel preferably communicates with a vent disposed at or near the uppermost portion of the roof, that is, with a ridge vent or similar ventilation opening. The siphon duct draws the heated layer of air from the upper portions of the room and discharges the heated air into the draft channel located in the attic, thereby cooling the room to a lower temperature.

The draft channel is preferably provided with an opening near the lowermost end thereof, which opening communicates with the interior of the attic, heated air within the attic thereby being drawn into the draft channel due to the natural "chimney-like" flow of air between the soffit vent and the ridge vent, that is, the natural flow of air from externally of the building through the soffit vent and subsequently through the draft channel and then out of the attic through the ridge vent or other upper ventilation opening. Heated air from internally of both the upper portions of the rooms of the building and the attic is thus vented from the building, thereby minimizing thermal loading within the building.

An exhaust fan can optionally be provided in the siphon duct to increase the flow of air from the room into the draft channel. Further, the draft channel can be lined with a radiant reflective material, such as aluminum foil, to additionally reduce heat loading within the building.

It is therefore an object of the present invention to provide a method and apparatus for venting heated air from the upper portions of a room in a dwelling or the like, thereby to reduce heat loading within a building.

It is another object of the present invention to provide a siphon duct structure which communicates with the upper portions of a room at a lowermost end and an uppermost end with a draft channel formed essentially within an attic or similar space surmounted by the roof of a building, heated air being drawn from the upper portions of environmental spaces within the building into the draft channel for discharge from the building through an upper ventilation opening.

It is a further object of the invention to provide a method and apparatus for venting heated air from the upper portions of environmental spaces within a building and from an attic or similar space immediately below the roof of the building, this heated air being ducted into a natural air flow path established between upper and lower roof ventiliation openings.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is an elevational view in section of the upper portion of a dwelling such as a house, the dwelling comprising an attic and environmental spaces or rooms located directly beneath the attic space;

FIG. 2 is a sectional view taken substantially along line 2—2 of FIG. 1;

FIG. 3 is a detailed sectional view of a portion of a building structure configured according to the teachings of a second embodiment of the invention; and FIG. 4 is a detailed sectional view of a siphon duct according to the invention having a fan disposed therein for increasing the flow of heated air through the duct.

DESCRIPTION OF THE PREFERRED EMBODIMENTS

Referring now to the drawings and particularly to FIGS. 1 and 2, a building is seen generally at 10 to comprise a roof 12 which surmounts and partially encloses a space typically referred as an attic 13. The attic 13 is further bounded and defined by upper surface portions of a ceiling 14 surmounting a typical room 16. According to the teachings of the present invention, upper portion 18 of the room 16 substantially acts as a heat trap particularly during periods of warm weather. Solar heat incident on the roof 12 typically causes a substantial increase in the thermal loading in the attic 13, such heat loading being further transmitted through the ceiling 14, even if insulated, to the upper portion 18 of the room 16. Typically, the upper 12 to 24 inches of the room 16 has a relatively higher temperature layer of air than is present in the lower portions of the room. In order to vent this undesirable layer of heated air from the room 16, a siphon duct 20 is disposed between the upper portion 18 of the room 16 and upper portions of the attic 13 as will be described hereinafter. The siphon duct 20 preferably comprises a length of pipe of a diameter conveniently taken to be approximately 6 inches. Lower end 22 of the siphon duct 20 is seen to extend through the ceiling 14 and to fit substantially flushly with lowermost planar surfaces of said ceiling 14. This open lower end 22 of the siphon duct 20 is preferably spaced approximately two feet from sidewall 21. The heated air within the upper portion 18 of the room 16 naturally flows into the open lower end 22 of the siphon duct 20, this natural flow being augmented as will be described hereinafter.

The siphon duct 20 extends outwardly through the attic 13 and terminates in a first embodiment of the invention with a nozzle 26 formed on upper end 24 of said siphon duct 20. The nozzle 26, which can also be seen in FIG. 2, is disposed within a draft channel 34 which is defined by sides 36, a floor 38, and portions of the interior planar surfaces of the roof 12. The draft channel 34 substantially comprises a duct which is 6 inches deep by 24 inches wide and extends substantially from a point near the lowermost end of the roof 12 to a point substantially beneath the ridge line of the roof 12. As clearly seen in FIGS. 1 and 2, the opening of the nozzle 26 is directed diagonally upwardly within the draft channel 34 in a direction essentially parallel to a natural flow of air through the draft channel 34. Therefore, air exiting the upper portion 18 of the room 16 through the siphon duct 20 flows in a natural flow path along with air moving through the draft channel 34.

As can particularly be seen in FIG. 1, a soffit vent 40 is disposed under the eaves of the roof 12 to draw air into the attic 13 and then into the draft channel 34 from exteriorly of the building 10. Air entering the attic 13 through the soffit vent 40 flows substantially along the underside of the roof 12 and thus into the draft channel 34. An opening formed at 44 near the lower end of the draft channel 34 allows air within the attic 13 to also move into the draft channel 34 for ultimate discharge therefrom through a ridge vent 42 disposed substantially along the ridge line of the roof 12. Therefore, the natural "chimney-like" draft of air moving between the soffit vent 40 and the ridge vent 42 entrains air from the interior of the attic 13 and that air exiting into the draft channel 34 from the siphon duct 20 to discharge said air through the ridge vent 42 or any other ventilation opening disposed essentially above the siphon duct 20 and the opening 44. A relatively smaller apex opening 46 can be disposed in the floor 38 partially defining the draft channel 34, the apex opening 46 acting to vent air from within the attic 13 into the draft channel 34 and subsequently from the building 10 through the ridge vent 42.

The draft channel 34 can conveniently be defined by trusses comprising the roof 12, the trusses essentially forming the sides 36 of the draft channel 34. A length of plasterboard of sufficient width to extend between the trusses or sides 36 can be conveniently nailed to said sides 36 to form the floor 38 of the draft channel 34. Accordingly, the draft channel 34 conveniently has nominal dimensions of 6 inches by 24 inches, the depth of the draft channel 34 essentially being the width dimension of roof trusses which form the sides 36, the width of the draft channel 34 essentially being the spacing between such trusses. The interior of the draft channel 34 is preferably lined with a layer 48 of reflective material, such as aluminum foil. This layer 48 preferably has a low absorptivity to emissivity ratio and acts to reflect radiation which produces heat within the attic 13 if allowed to be absorbed by the air within the attic 13.

As can be seen in FIGS. 1, 3, and particularly in FIG. 4, the lower end 22 of the siphon duct 20 is provided with a damper plate 28 which has a peripheral beveled flange 29 disposed thereabout, the flange 29 extending upwardly to allow the open lower end 22 of the siphon duct 20 to be closed by displacement of said damper plate 28 upwardly into engagement with the lower end 22. The damper plate 28 is seen to be provided with a plurality of arms 30 which terminate at the upper ends thereof in essentially semi-circular ridges 31, the ridges 31 biasing against the interior of the siphon duct 20 to provide a frictional fit of the damping mechanism within the duct 20. A knob 32 formed on the lower surface of the lamper plate 28 allows the damping mechanisms to be grasped and displaced within the lower end 22 of the siphon duct 20.

Referring now to FIG. 3, the siphon duct 20 is seen in a second embodiment of the invention to be formed with an upper end 52 the edges of which are formed substantially parallel to the flow of air through the draft channel 34. This substantially parallel flow of air past the open upper end 52 of the siphon duct 20 creates a venturi-like effect to increase the flow of air from the upper portion 18 of the room 16 through the siphon duct 20.

Referring now particularly to FIG. 4, the siphon duct 20 is seen to be provided with a fan 54 which acts to increase the flow rate of air from the upper portion 18 of the room 16 through the siphon duct 20, the fan 54 drawing air from the lower end 22 thereof and displacing said air toward the upper end 24 of the siphon duct 20.

A building 10 in which the present invention is installed can be cooled substantially as well with proper insulation as can a building 10 utilizing mechanical refrigeration. In particular, if a window (not shown) be opened sightly in the evening, air flow through the siphon duct 20 is increased and causes the room to be readily cooled. In the morning, the window (or other source of draft) should be shut. It should also be understood that the siphon duct 20 can be utilized in rooms in floors of a multi-story building not adjacent to the attic 13 or the roof 12. The siphon duct 20 can be caused to communicate with rooms on the lower floors of a multi-story buildings by causing the duct 20 to be disposed within wall partitions between said rooms and the roof of a buiding. According to the primary teachings of the present invention, heated air is vented from the upper portion 18 of the room 16 by means of the siphon duct 20. The invention can also be utilized to vent heated air from the attic 13 of a building 10 through the same draft channel 34 which is utilized to vent heated air from the room 16.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a building having a roof and at least one environmental space separated from the roof by at least a ceiling and an attic-like space between the roof and the ceiling, apparatus for causing heated air from the upper portions of the room to be vented from the building, comprising:

a siphon duct member extending between the ceiling and upper portions of the attic-like space, the siphon duct member being opened at lower and upper ends, the lower end of the siphon duct member communicating with the upper portions of the room;

means for defining a draft channel within the attic-like space, the upper end of the siphon duct member extending into the draft channel and communicating with the interior thereof to discharge air from the room into the draft channel;

vent means for causing a flow of air through the draft channel from and to wherein the vent means comprise:

a soffit vent formed in a lower portion of the roof and communicating the interior of the attic-like space with ambient, the soffit vent channeling a flow of ambient air into the attic-like space and subsequently into the draft channel; and, a ridge vent formed in an upper portion of the roof and communicating the interior of the draft channel with ambient, flow of air from the soffit vent passing through the draft channel and out of the building through the ridge vent.

2. In the structure of claim 1 and further comprising a nozzle member on the upper end of the siphon duct member, the nozzle member directing air flowing through the siphon duct member into the draft channel in a direction substantially coincidental with the direction of air flow within said draft channel.

3. In the structure of claim 1 wherein the upper end of the siphon duct member has the edges thereof aligned parallel with the direction of air flow within the draft channel.

4. In the structure of claim 1 and further comprising a fan disposed within the siphon duct member and adapted to evacuate air from the upper portions of the room into the draft channel.

5. In the structure of claim 1 wherein the means for defining the draft channel has an opening formed therein near the lowermost end of the draft channel, the opening communicating the draft channel with the interior of the attic-like space.

6. In the structure of claim 1 wherein the means for defining the draft channel has an opening formed therein near the uppermost end of the draft channel, the opening communicating the draft channel with the interior of the attic-like space.

7. In the structure of claim 1 and further comprising a layer of heat reflective material disposed at least on the upwardly facing surfaces defining the draft channel.

* * * * *